US007564197B2

(12) United States Patent
Kimura et al.

(10) Patent No.: US 7,564,197 B2
(45) Date of Patent: Jul. 21, 2009

(54) DISCHARGE TUBE OPERATION DEVICE

(75) Inventors: Kengo Kimura, Saitama (JP); Toru Ashikaga, Saitama (JP)

(73) Assignee: Sanken Electric Co., Ltd., Saitama (JP)

( * ) Notice: Subject to any disclaimer, the term of this patent is extended or adjusted under 35 U.S.C. 154(b) by 302 days.

(21) Appl. No.: 10/543,849

(22) PCT Filed: Dec. 26, 2003

(86) PCT No.: PCT/JP03/16884

§ 371 (c)(1),
(2), (4) Date: Apr. 21, 2006

(87) PCT Pub. No.: WO2004/068914

PCT Pub. Date: Aug. 12, 2004

(65) Prior Publication Data

US 2006/0214606 A1 Sep. 28, 2006

(30) Foreign Application Priority Data

Jan. 29, 2003 (JP) ..... 2003-021106

(51) Int. Cl.
*G05F 1/00* (2006.01)

(52) U.S. Cl. ..... 315/307; 315/224; 315/291; 315/209 R; 315/DIG. 4

(58) Field of Classification Search ..... 315/209 R, 315/224, 307, 291, DIG. 4; 363/24, 25, 39–41, 363/98, 97, 95, 78, 74, 13
See application file for complete search history.

(56) References Cited

U.S. PATENT DOCUMENTS 5,039,921 A 8/1991 Kakitani
5,097,181 A 3/1992 Kakitani
5,463,287 A 10/1995 Kurihara et al.
5,773,937 A 6/1998 Miyazaki et al.
5,796,213 A * 8/1998 Kawasaki ..... 315/209 R
6,118,221 A * 9/2000 Kumasaka et al. ..... 315/224
6,259,615 B1 * 7/2001 Lin ..... 363/98

FOREIGN PATENT DOCUMENTS

CN 1368789 9/2002
JP 06-096891 A 4/1994
JP 08-078180 A 3/1996

(Continued)

OTHER PUBLICATIONS

"Denki Kogaku Pocket book", ed. by The Institute of Electrical Engineers of Japan, Ohmsha, Ltd., 4th ed. (1987), pp. 238-242.

*Primary Examiner*—Douglas W Owens
*Assistant Examiner*—Ephrem Alemu
(74) *Attorney, Agent, or Firm*—Townsend and Townsend and Crew LLP

(57) ABSTRACT

A time division signal (S2) for instructing a lit period and an unlit period of a discharge tube (23) is input to an error amplifier (41) of an integration circuit (40). The integration circuit (40) charges and discharges a capacitor (42) in accordance with the time division signal (S2). By utilizing this operation, a control circuit (49) adjusts a current flowing through the discharge tube (23) to light and extinguish the discharge tube (23).

10 Claims, 6 Drawing Sheets

FOREIGN PATENT DOCUMENTS

| | | | |
|---|---|---|---|
| JP | 10-172780 | | 6/1998 |
| JP | 2000-172780 | | 6/2000 |
| JP | 2001-502160 | A | 2/2001 |
| JP | 2001-128460 | A | 5/2001 |
| JP | 2001-196196 | | 7/2001 |
| JP | 2001-196196 | A | 7/2001 |
| JP | 2001-338791 | | 12/2001 |
| JP | 2001-357995 | A | 12/2001 |
| JP | 2002-043088 | A | 2/2002 |
| JP | 2002-216982 | | 8/2002 |
| JP | 2002-233158 | A | 8/2002 |
| JP | 2003-100480 | | 4/2003 |
| TW | 00566058 | | 12/2003 |
| TW | 00569648 | | 1/2004 |
| TW | 00569649 | | 1/2004 |
| TW | 00595267 | | 6/2004 |
| TW | 200421941 | | 10/2004 |
| TW | 200425800 | | 11/2004 |
| TW | 200503015 | | 1/2005 |

* cited by examiner

DISCHARGE TUBE OPERATION DEVICE

TECHNICAL FIELD

The present invention relates to a discharge tube operation device which adjusts the illuminance of a discharge tube by adjusting a current flowing through the discharge tube.

BACKGROUND ART

Among discharge tube operation devices used in liquid crystal backlights, etc., there are such devices that adjust the illuminance of the discharge tube by adjusting a current flowing through the discharge tube by feedback-controlling the current in the discharge tube, as disclosed in, for example, Unexamined Japanese Patent Application KOKAI Publication No. 2002-43088.

The general configuration of a conventional discharge tube operation device of this type is illustrated in FIG. 4. The conventional discharge tube operation device comprises a direct-current power source V3, a DC-AC(direct-current-alternating-current) conversion circuit 50, a resonance section 60, a discharge tube current detection circuit 70, a soft-start circuit 80, an error amplifier 83, a control circuit 87, a time division signal output circuit 85, and a reference voltage power source V4.

The DC-AC conversion circuit 50 converts a direct-current voltage supplied from the direct-current power source V3 to an alternating-current voltage by switching the voltage through MOSFETs 51 and 52.

The resonance section 60 comprises a transformer 61, a capacitor 62, and a discharge tube 63. The capacitor 62, a secondary coil 61*b* of the transformer 61, and the discharge tube 63 constitute a resonance circuit, which resonates at a unique resonance frequency.

The discharge tube current detection circuit 70 is constituted by diodes 71 and 72, and a resistor 73, detects the current level of a current I2 flowing through the discharge tube 63, and supplies an output signal to the soft-start circuit 80.

The soft-start circuit 80 is constituted by a resistor 81 and a capacitor 82, smoothes the output signal from the discharge tube current detection circuit 70, and supplies a signal E2 to a positive input terminal (+) of the error amplifier 83.

The error amplifier 83 is constituted by a differential amplifier, and a fixed reference voltage Vr from the reference voltage power source V4 is applied to a negative (inverting) input terminal (−) of the error amplifier 83. A capacitor 84 is connected between the output end of the error amplifier 83 and the output terminal of the reference voltage power source V4. The error amplifier 83 obtains the potential difference between the voltage of the signal E2 supplied from the soft-start circuit 80 and the reference voltage Vr, and supplies a voltage signal E3 to the control circuit 87.

The time division signal output circuit 85 has a luminance designation signal S3, which designates the luminance of the discharge tube 63, supplied to its input terminal. This luminance designation signal S3 indicates, for example, the ratio of a desired luminance to the rated luminance of the discharge tube 63. The time division signal output circuit 85 generates a time division signal S4 having a constant period and a variable duty ratio, in accordance with the designation by this luminance designation signal S3. That is, the time division signal output circuit 85 increases the ratio of a lit period (L-level period) occupied in one period in a case where the luminance designated by the luminance designation signal S3 is large, and reduces the ratio of a lit period (L-level period) occupied in one period in a case where the luminance designated by the luminance designation signal S3 is small.

The voltage of the time division signal S4 output by the time division signal output circuit 85 is added to the voltage of the output signal E2 from the soft-start circuit 80 and then supplied to the positive input terminal of the error amplifier 83. Accordingly, in a period in which the time division signal S4 is H level, an H level is applied to the positive input terminal of the error amplifier 83 regardless of the voltage level of the output signal E2 of the soft-start circuit 80, while in a period in which the time division signal S4 is L level, a voltage of almost the same level as the voltage level of the output signal E2 of the soft-start circuit 80 is applied to the positive input terminal of the error amplifier 83.

The control circuit 87 switches on or off the MOSFETs 51 and 52 in a manner that the voltage of the output signal E2 of the soft-start circuit 80 and the reference voltage Vr will be the same.

Next, the operation of the discharge tube operation device having the above-described configuration will be explained.

When given an instruction to light the discharge tube 63, the control circuit 87 starts the operation of switching on or off the MOSFETs 51 and 52. In response to this, a direct-current voltage is switched and an alternating-current voltage is output from the DC-AC conversion circuit 50. This alternating-current voltage is applied to a primary coil 61*a* of the transformer 61. A resonance voltage due to the resonance effect of the resonance section 60 is induced in the secondary coil 61*b* and applied to the discharge tube 63, thereby the discharge tube 63 is lit.

The discharge tube current detection circuit 70 detects the current level of a current 12 flowing through the discharge tube 63, and outputs a voltage corresponding to the detected current level from the cathode of a diode 71. The soft-start circuit 80 smoothes the output signal from the discharge tube current detection circuit 70, and supplies a signal E2 to the positive input terminal of the signal error amplifier 83.

The error amplifier 83 supplies a voltage signal E3 corresponding to the potential difference between the voltage of the signal E2 supplied from the soft-start circuit 80 and the reference voltage Vr to the control circuit 87. The control circuit 87 controls the switching frequencies of the MOSFETs 51 and 52 in a manner that the output signal E2 from the soft-start circuit 80 (=terminal voltage E2 of the capacitor 82) and the reference voltage Vr will have no potential difference.

With repetition of this control operation, the discharge tube current I2 is adjusted to a level corresponding to the reference voltage Vr.

After lighting the discharge tube 63, the discharge tube operation device adjusts the luminance of the discharge tube 63 to the luminance level designated by the designation signal S3 supplied to the time division signal output circuit 85. Hereinafter, the method of adjusting the luminance of the discharge tube 63 will be explained with reference to FIGS. 5.

FIG. 5A to FIG. 5D show the time division signal S4, the terminal voltage E2 of the capacitor 82, the voltage signal E3 of the error amplifier 83, and the current I2 of the discharge tube 63 respectively.

In FIG. 5, t0 and t5 indicate the timings at which the time division signal S4 supplied to the error amplifier 83 rises to H level, and t1 indicates the timing at which the time division signal S4 falls to L level.

The time division signal output circuit 85 determines the duty ratio of the time division signal S4 in accordance with the luminance level designated by the luminance designation signal S3, and outputs the time division signal S4 having the determined duty ratio.

When the time division signal S4 becomes H level at the timing t0 as shown in FIG. 5A, the voltage (=terminal voltage of the capacitor 82) E2 of the positive input terminal of the error amplifier 83 increases as shown in FIG. 5B. In response to this, the voltage signal E3 of the error amplifier 83 increases as shown in FIG. 5C.

The control circuit 87 controls the switching frequencies of the MOSFETs 51 and 52 such that they will differ from the resonance frequency, based on the increased voltage signal E3 of the error amplifier 83. At this time, no resonance voltage is generated because the resonance section 60 is not excited. Accordingly, the discharge tube current 12 is shut off as shown in FIG. 5D.

Next, when the time division signal S4 changes from H to L level at the timing t1, the voltage E2 of the output signal of the soft-start circuit 80 is applied, almost as is, to the positive input terminal of the error amplifier 83. This voltage E2 gradually decreases as shown in FIG. 5B, because the capacitor 82 gradually discharges.

After this, when the terminal voltage (=E2) of the capacitor 82 becomes closer to the reference voltage Vr at the timing t2, the voltage signal E3 of the error amplifier 83 decreases as shown in FIG. 5C.

The control circuit 87 controls the switching frequencies of the MOSFETs 51 and 52 such that they will approach the resonance frequency of the resonance section 60, based on the decreasing voltage signal E3 of the error amplifier 83. Due to this, the resonance section 60 is again excited to generate a resonance voltage. Accordingly, as shown in FIG. 5D, the discharge tube current I2 flows and the discharge tube 63 is lit (t=3).

After the discharge tube 63 is lit, the control circuit 87 performs feedback control in a manner that the potential difference between the terminal voltage E2 of the capacitor 82 and the reference voltage Vr will become extinct. Then, the current level of the current I2 of the discharge tube 63 is controlled.

In this manner, this discharge tube operation device adjusts the lit period and unlit period of the discharge tube 63 according to repetition of H level and L level of the time division signal S4.

In the conventional discharge tube operation device, if a time constant $\tau$, which is determined by the resistance of the resistor 81 and capacitance of the capacitor 82 of the soft-start circuit 80, is small, an overrun is caused due to a delay in the feedback control system. Because of the overrun, a surge occurs in the current I2 flowing through the discharge tube 63 at the timing t3 in FIG. 5D. The occurrence of this surge will be a cause of shortening the life of the discharge tube 63.

To prevent the occurrence of a surge, the time constant $\tau$ of the soft-start circuit 80 may be set large. FIGS. 6A to D show the time division signal S4, terminal voltage E2 of the capacitor 82, voltage signal (output signal) E3 of the error amplifier 83, and current I2 of the discharge tube 63 of a case where the time constant is large.

When the time constant $\tau$ is large, a period (a period from t1 to t2) before the output voltage E3 of the error amplifier 83 starts decreasing becomes large in proportion to the time constant $\tau$ of the soft-start circuit 80, as shown in FIG. 6C.

That is, the time taken from the timing t1 at which the time division signal S4 becomes L level to the timing t3 at which the discharge tube current I2 starts flowing through the discharge tube 63 increases, as shown in FIG. 6D.

Due to this, a gap is produced between the period in which the time division signal S4 is L level and the period in which the discharge tube current I2 is flowing and the lit period t3 to t5 of the discharge tube is shortened, as shown in FIG. 6A and FIG. 6D. Since the lit period of the discharge tube 63 is short, the light-emitting luminance of the discharge tube 63 results in a level lower than designated by the luminance designation signal.

As described above, the discharge tube operation device having the conventional soft-start circuit 80 encounters the case where the luminance level of the discharge tube 63 does not reach the luminance level designated by the luminance designation signal S3, if the time constant $\tau$ of the soft-start circuit 80 is set large in order to suppress occurrence of a surge.

DISCLOSURE OF INVENTION

The present invention was made in view of the above circumstance, and an object of the present invention is to provide a discharge tube operation device which can achieve a desired illuminance while also suppressing occurrence of a surge.

Another object of the present invention is to provide a discharge tube operation device which can secure a sufficient lit period in order to achieve a desired illuminance while also suppressing occurrence of a surge.

To solve the above-described problem, a discharge tube operation device according to a first aspect of the present invention comprises: a DC-AC conversion circuit (10) which generates an alternating-current voltage by switching a direct-current voltage in accordance with a control signal; a resonance circuit (20) which is supplied with the alternating-current voltage from the DC-AC conversion circuit (10) and resonates with the alternating-current voltage thereby to flow a current through a discharge tube (23), which is an object of lighting, and light the discharge tube (23); a discharge tube current detection circuit (30) which detects a current level of the current flowing through the discharge tube (23) and outputs a detection signal having a signal level corresponding to the detected current level; an integration circuit (40) which includes a feedback capacitor (42) and integrates the signal level of the detection signal; a control circuit (49) which controls switching of the DC-AC conversion circuit (10) in accordance with a signal level of an output signal of the integration circuit (40), thereby to output a control signal for controlling energy to be transmitted from the DC-AC conversion circuit (10) to the resonance circuit (20); and a time division signal output circuit (48) which generates a time division signal (S2), which is a signal for repeatedly instructing a lit period and an unlit period of the discharge tube (23) for time-division-driving the discharge tube (23) and has a signal level that transmits energy capable of lighting the discharge tube (23) from the DC-AC conversion circuit (10) to the resonance circuit (20) in a period in which lighting is instructed and that transmits energy incapable of lighting the discharge tube (23) from the DC-AC conversion circuit (10) to the resonance circuit (20) in a period in which non-lighting is instructed, and adds the time division signal (S2) to the signal level of the detection signal.

By employing such a configuration, a sufficient lit period can be obtained and a desired illuminance can therefore be obtained.

The DC-AC conversion circuit (10) may switch a direct-current voltage at a frequency which is in accordance with the control signal; the resonance circuit (20) may have a unique resonance frequency, and may resonate when a frequency of the alternating-current voltage supplied from the DC-AC conversion circuit (10) coincides with the resonance frequency thereby to flow a current through the discharge tube (23), which is the object of lighting, and light the discharge tube (23); the control circuit (49) may control a switching frequency of the DC-AC conversion circuit (10) in accordance with the signal level of the output signal of the integration circuit (40); and the time division signal output circuit (48) may generate a time division signal (S2), which is a signal for repeatedly instructing a lit period and an unlit period of the discharge tube (23) for time-division-driving the discharge tube (23) and has a signal level that makes the frequency of the alternating-current voltage coincide with the resonance frequency in a period in which lighting is instructed and that makes the frequency of the alternating-current voltage differ from the resonance frequency in a period in which non-lighting is instructed, and may add the time division signal (S2) to the signal level of the detection signal.

The DC-AC conversion circuit (10) may switch a direct-current voltage at a duty ratio which is in accordance with the control signal; the resonance circuit (20) may have a unique resonance frequency, and may resonate when a frequency of the alternating-current voltage supplied from the DC-AC conversion circuit (10) coincides with the resonance frequency thereby to flow a current through the discharge tube (23), which is the object of lighting; the control circuit (49, 49*b*) may control the duty ratio of switching of the DC-AC conversion circuit (10) in accordance with the signal level of the output signal of the integration circuit (40); and the time division signal output circuit (48) may generate a time division signal (S2), which is a signal for repeatedly instructing a lit period and an unlit period of the discharge tube (23) for time-division-driving the discharge tube (23) and has a signal level that gives a duty ratio at which energy sufficient for lighting is transmitted in a period in which lighting is instructed and that gives a duty ratio at which energy incapable of lighting is transmitted in a period in which non-lighting is instructed, and may add the time division signal (S2) to the signal level of the detection signal.

The feedback capacitor may be a capacitor (42); the integration circuit (40) may have an integration circuit resistive element (43); the discharge tube current detection circuit (30) may have a discharge tube current detection resistive element (33) for detecting a voltage of the current flowing through the discharge tube (23); and a time constant of the integration circuit (40) may be determined by capacitance of the capacitor (42) and resistances of the integration circuit resistive element (43) and the discharge tube current detection element (33).

The resonance circuit (20) may have a transformer (21) which includes a primary coil (21*a*) that is connected to the DC-AC conversion circuit (10) and a secondary coil (21*b*) that is coupled to the primary coil (21*a*) and supplies a voltage to the discharge tube (23).

To solve the above problem, a discharge tube operation device according to a second aspect of the present invention comprises: a DC-AC conversion circuit (10) which generates an alternating-current voltage by switching a direct-current voltage at a frequency which is in accordance with a control signal; a resonance circuit (40) which has a unique resonance frequency, is supplied with an alternating-current voltage from the DC-AC conversion circuit (10), and resonates when a frequency of the alternating-current voltage coincides with the resonance frequency thereby to flow a current through a discharge tube (23), which is an object of lighting, and light the discharge tube (23); a discharge tube current detection circuit (30) which detects a current level of the current flowing through the discharge tube (23), and outputs a detection signal having a signal level corresponding to the detected current level; an integration circuit (40) which has a feedback capacitor (42) and integrates the signal level of the detection signal; a control circuit (49) which outputs a control signal for controlling a switching frequency of the DC-AC conversion circuit (10) in accordance with a signal level of an output signal of the integration circuit (40); and a time division signal output circuit (48) which generates a time division signal (S2), which is a signal for repeatedly instructing a lit period and an unlit period of the discharge tube (23) for time-division-driving the discharge tube (23) and has a signal level that makes the frequency of the alternating-current voltage coincide with the resonance frequency in a period in which lighting is instructed and that makes the frequency of the alternating-current voltage differ from the resonance frequency in a period in which non-lighting is instructed, and adds the time division signal (S2) to the signal level of the detection signal.

By employing such a configuration, a desired illuminance can be obtained while occurrence of a surge is suppressed. Further, a sufficient lit period for obtaining a desired illuminance can be obtained while occurrence of a surge is suppressed.

To solve the above problem, a discharge tube operation device according to a third aspect of the present invention comprises: a DC-AC conversion circuit (10) which generates a pulse by switching a direct-current voltage in accordance with a control signal; a resonance circuit (20) which is connected to the DC-AC conversion circuit (10), generates a voltage based on a width of the pulse, and flows a current through the discharge tube (23) based on the voltage thereby to light the discharge tube (23); a discharge tube current detection circuit (30) which is connected to the resonance circuit (20), detects a current value of the current flowing through the discharge tube (23), and outputs an electric signal corresponding to the current value;

an integration circuit (40) which includes a difference circuit (41) for obtaining a difference between a reference value and the electric signal, a capacitor (42) connected between an input terminal and output terminal of the difference circuit (41), and an element (43) for setting a charging/discharging speed of the capacitor (42), and integrates the electric signal; a control circuit (49*b*) which generates a control signal for changing the width of the pulse based on an output signal of the integration circuit (40); and a time division signal output circuit (48) which supplies a time division signal (S2) whose electric signal level changes in a periodic unlit period in which the discharge tube (23) is unlit, to the integration circuit (40) while embedding the time division signal (S2) on the electric signal, thereby to change the output signal of the integration circuit (40) in the unlit period to change the width of the pulse, make the discharge tube (23) unlit and adjust illuminance of the discharge tube (23).

By employing such a configuration, it is possible to provide a discharge tube operation device capable of obtaining a desired illuminance while suppressing occurrence of a surge. Further, it is possible to provide a discharge tube operation device capable of obtaining a sufficient lit period for obtaining a desired illuminance while suppressing occurrence of a surge.

BEST MODE FOR CARRYING OUT THE INVENTION

A discharge tube operation device according to the embodiments of the present invention will be explained below with reference to the drawings.

First Embodiment

Figure 1:
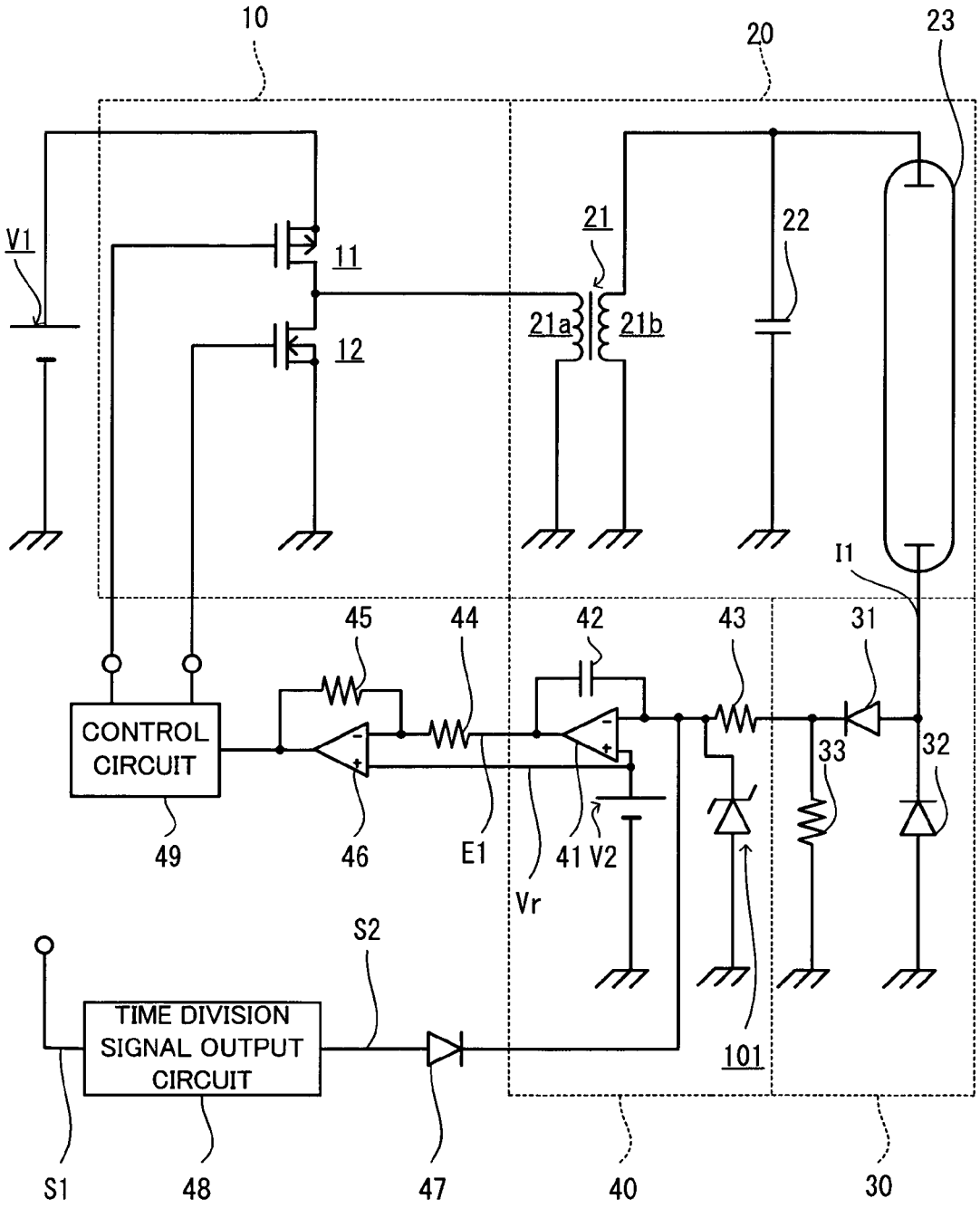
FIG. 1 is a circuit diagram showing the configuration of a discharge tube operation device according to a first embodiment of the present invention.

FIG. 1 is a block diagram of a discharge tube operation device according to the first embodiment of the present invention.

This discharge tube operation device comprises a direct-current power source V1, a DC-AC conversion circuit 10, a resonance circuit 20, a discharge tube current detection circuit 30, an integration circuit 40, a subtractor 46, a time division signal output circuit 48, and a control circuit 49.

The direct-current power source V1 is a power source that supplies a direct-current voltage to the DC-AC conversion circuit 10, and its negative electrode (−) is earthed while its positive electrode (+) is connected to the DC-AC conversion circuit 10.

The DC-AC conversion circuit 10 comprises a MOSFETs 11 and 12 functioning as switching elements. The MOSFETs 11 and 12 form a complementary circuit and are connected between the direct-current power source V1 and the ground.

The DC-AC conversion circuit 10 converts a direct-current voltage into an alternating-current voltage by switching the direct-current voltage through the MOSFETs 11 and 12.

The source of the MOSFET 11 is connected to the positive electrode (+) of the direct-current power source V1, and the drain of the MOSFET 11 is connected to the drain of the MOSFET 12. The source of the MOSFET 12 is earthed.

The resonance circuit 20 comprises a transformer 21, a capacitor 22, and a discharge tube 23. One end of the primary coil 21*a* of the transformer 21 is connected to the connection node between the drain of the MOSFET 11 and the drain of the MOSFET 12.

One end of the secondary coil 21*b* of the transformer 21 is connected to one electrode of the capacitor 22 and to one electrode of the discharge tube 23. The other ends of the primary coil 2*a* and secondary coil 21*b* and the other electrode of the capacitor 22 are earthed.

The resonance circuit 20 resonates at a unique resonance frequency and produces a resonance frequency in the secondary coil 21*b*.

The discharge tube current detection circuit 30 comprises diodes 31 and 32 and a discharge tube current detection resistor 33, detects the current level of a current I1 flowing through the discharge tube 23, and supplies a detection signal to the integration circuit 40.

The anode of the diode 31 and the cathode of the diode 32 are connected to the other electrode of the discharge tube 23. The anode of the diode 32 and one end of the discharge tube current detection resistor 33 are earthed. And the cathode of the diode 31 and the other end of the discharge tube current detection resistor 33 are connected to the integration circuit 40, as will be described later.

The integration circuit 40 comprises an error amplifier 41, a capacitor 42, a resistor 43, a reference voltage power source V2, and a voltage clamp circuit 101. The reference voltage power source V2 is a power source that supplies a potential (reference voltage Vr) referred to as a reference for the operation of the error amplifier 41, to the positive input terminal (+) of the error amplifier 41, and the negative electrode (−) thereof is earthed. The positive electrode (+) thereof is connected to the positive input terminal (+) of the error amplifier 41.

The capacitor 42 is charged or discharged in accordance with a time division signal S2 generated by the time division signal output circuit 48 to be described later.

The voltage clamp circuit 101 is connected between the negative input terminal (−) of the error amplifier 41 and the ground, and restricts any input voltage to the error amplifier 41 at a voltage value slightly higher than the voltage (reference voltage Vr) value of the reference voltage power source V2.

The integration circuit 40 supplies a voltage signal corresponding to the potential difference between the voltage of a detection signal of the discharge tube current detection circuit 30 and the reference voltage Vr, to the control circuit 49.

The error amplifier 41 is constituted by a differential amplifier circuit, and has the capacitor 42 connected between its output terminal and its negative input terminal (−). Further, the negative input terminal (−) is connected via the resistor 43 to the cathode of the diode 31 and the other terminal of the discharge tube current detection resistor 33. The error amplifier 41 supplies a voltage signal E1 corresponding to the potential difference between the voltage of the detection signal of the discharge tube current detection circuit 30 and the reference voltage Vr to the subtractor 46.

The positive input terminal (+) of the error amplifier 41 is connected to the output terminal of the reference voltage power source V2 as described above, and the output terminal of the error amplifier 41 is connected to the negative input terminal (−) of the subtractor 46 via a resistor 44. A resistor 45 is connected between the output terminal and negative input terminal (−) of the subtractor 46.

The subtractor 46 is an inverting amplifier circuit that inverts the characteristic of the voltage signal E1 of the error amplifier 41, and its output terminal is connected to the control circuit 49, as will be described later.

The output terminal of the time division signal output circuit 48 is connected to the anode of a diode 47. The cathode of the diode 47 is connected between the resistor 43 and the (−) input terminal of the error amplifier 41.

The time division signal output circuit 48 generates a time division signal S2 when a luminance designation signal S1 that designates the luminance of the discharge tube 23 is input to its input terminal. This time division signal S2 indicates, for example, the ratio of a desired luminance to the rated luminance of the discharge tube 23. The time division signal output circuit 48 generates a time division signal S2 having a constant period and a variable duty ratio, in accordance with the designation of this luminance designation signal S1. That is, the time division signal output circuit 48 increases the ratio of a lit period (L-level period) occupied in one period in a case where the luminance designated by the luminance designation signal S1 is large, and reduces the ratio of a lit period (L-level period) occupied in one period in a case where the luminance designated by the luminance designation signal S1 is small.

In a period in which a time division signal S2 is H level, the diode 47 is turned on to put the output terminal of the time division signal output circuit 48 and the negative input terminal (−) of the error amplifier 41 in electrical connection with each other. Further, in a period in which the time division signal S2 is L level, the diode 47 is turned off thereby the output terminal of the time division signal output circuit 48 and the negative input terminal (−) of the error amplifier 41 are electrically disconnected.

Therefore, in the period in which the time division signal S2 is H level, the voltage of the time division signal S2 output from the time division signal output circuit 48 is added to the voltage of the detection signal of the discharge tube current detection circuit 30 and supplied to the negative input terminal (−) of the error amplifier 41. Accordingly, in the period in which the time division signal S2 is H level, an H level is applied to the negative input terminal (−) of the error amplifier 41 regardless of the voltage level of the detection signal of the discharge tube current detection circuit 30, while in the period in which the time division signal S2 is L level, a voltage having almost the same level as the voltage level of the detection signal of the discharge tube current detection circuit 30 is applied to the negative input terminal (−) of the error amplifier 41.

The input terminal of the control circuit 49 is connected to the output terminal of the subtractor 46, and two output terminals thereof are connected to the gates of the MOSFETs 11 and 12 respectively.

The control circuit 49 is a circuit that constitutes the feedback control system in cooperation with the discharge tube current detection circuit 30, the integration circuit 40, and the subtractor 46.

The control circuit 49 generates a control signal for switching on or off the MOSFETs 11 and 12 in a manner that the voltage of the detection signal of the discharge tube current detection circuit 30 and the reference voltage Vr will be the same.

The discharge tube operation device is configured as described above.

Next, the operation of the discharge tube operation device having the above-described configuration will be explained.

When a direct-current voltage is supplied from the direct-current power source V1, the MOSFETs 11 and 12 in the DC-AC conversion circuit 10 performs switching and generates an alternating-current voltage whose waveform is of a square wave at the connection node between the MOSFETs 11 and 12. The alternating-current voltage is applied to the primary coil 21*a*.

After the alternating-current voltage is applied to the primary coil 21*a* from the DC-AC conversion circuit 10, a resonance effect is generated by the capacitor 22, the impedance of the discharge tube 23, and the secondary coil 21*b*. Due to the resonance effect, a resonance voltage is induced in the secondary coil 21*b*. This resonance voltage is applied to the discharge tube 23 thereby to light the discharge tube 23. That is, when the frequency of the alternating-current voltage supplied from the DC-AC conversion circuit 10 coincides with the resonance frequency unique to the resonance circuit 20, the resonance circuit 20 resonates and flows a current through the discharge tube 23 to light the discharge tube 23.

When the discharge tube 23 is lit, in the discharge tube current detection circuit 30, the diodes 31 and 32 detect the current level of a current I1 flowing through the discharge tube 23 and output the detected current level from the cathode. Further, the resistor 33 detects the positive voltage of the current I1, and a detection signal corresponding to the detected voltage level is applied to the integration circuit 40 via the resistor 43.

The error amplifier 41 generates a voltage signal E1 corresponding to the potential difference between the voltage of the detection signal from the discharge tube current detection circuit 30 and the reference voltage Vr, and inputs the generated voltage signal E1 to the subtractor 46 via the resistor 44. The subtractor 46 inverts the voltage signal E1 of the error amplifier 41, and supplies it to the input terminal of the control circuit 49.

In order to make the voltage of the detection signal of the discharge tube current detection circuit 30 and the reference voltage Vr equal to each other in potential difference, the control circuit 49 generates a control signal for controlling the energy to be transmitted from the DC-AC conversion circuit 10 to the resonance circuit 20 by controlling the switching frequencies of the MOSFETs 11 and 12 based on the output signal supplied from the integration circuit 40. Then, the control circuit 49 supplies the generated control signal to the gates of the MOSFETs 11 and 12.

As a result, the MOSFETs 11 and 12 are complementarily switched on or off based on the control signal from the control circuit 49 to generate an alternating current. After the alternating current is applied to the primary coil 21*a* of the transformer 21 disposed in the resonance circuit 20, a resonance voltage is induced in the secondary coil 21*b*.

The resonance voltage induced at this time has been adjusted to the level corresponding to the reference voltage Vr. That is, the control circuit 49 adjusts the current I1 flowing through the discharge tube 23 to the level corresponding to the reference voltage Vr by controlling the switching frequencies of the MOSFETs 11 and 12.

In this manner, the discharge tube operation device according to the present embodiment adjusts the current level of the discharge tube current I1. Next, this discharge tube current operation device adjusts the luminance of the discharge tube 23 to the luminance level designated by the luminance designation signal S1 supplied to the time division signal output circuit 48. Hereinafter, the method of adjusting the luminance of the discharge tube 23 will be explained with reference to FIG. 2.

Figures 2A, 2B, 2C:
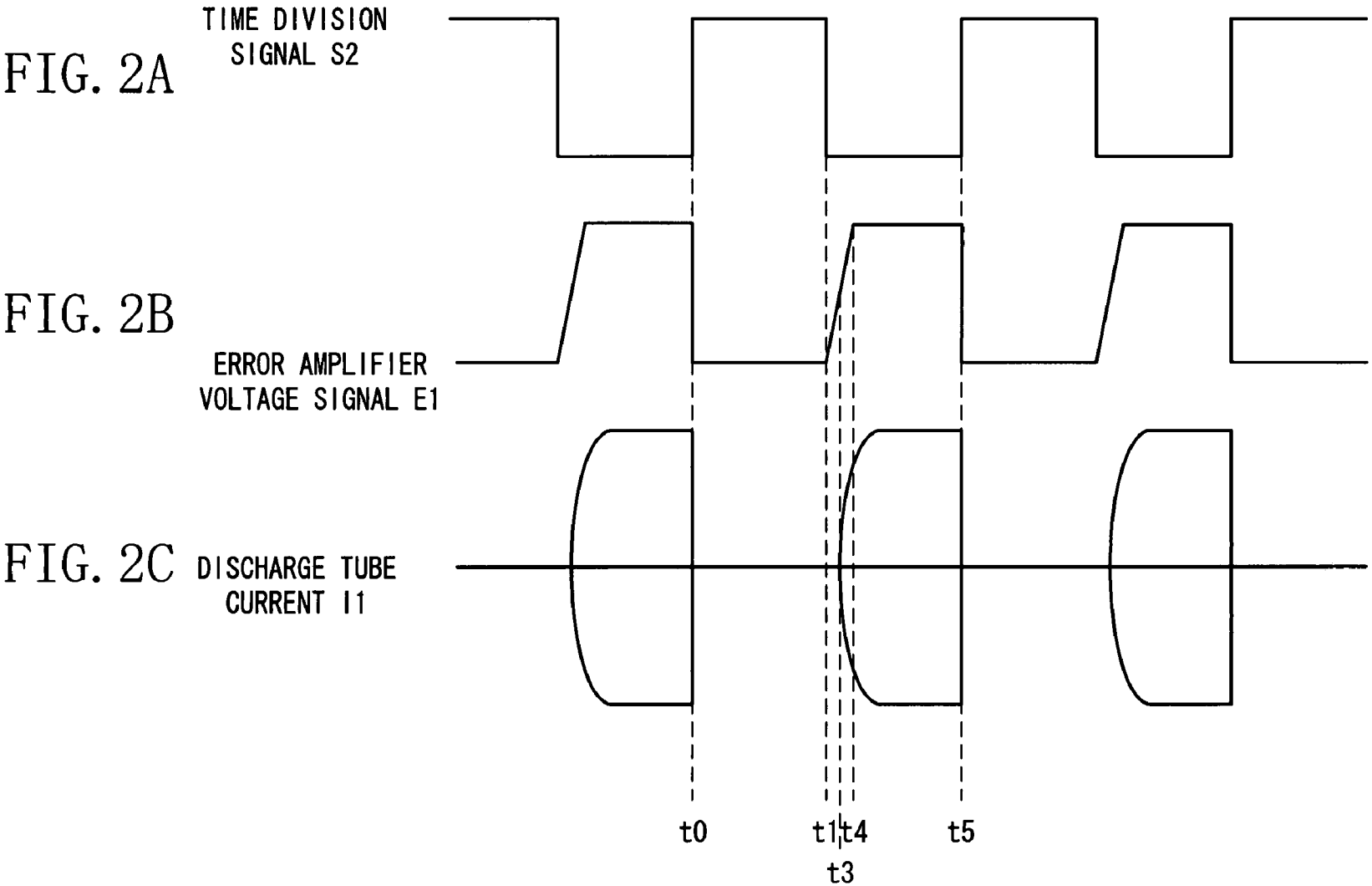
FIG. 2 are diagrams of waveforms for explaining the operation of the discharge tube operation device of FIG. 1.

FIGS. 2A to C show the time division signal S2, the voltage signal E1 of the error amplifier 41, and the current I1 of the discharge tube 23, respectively.

t0 and t5 in FIG. 2 are timings at which the time division signal S2 supplied to the error amplifier 41 rises from L level to H level, and t1 is a timing at which the time division signal S2 falls from H level to L level. t3 is a timing at which the current I1 starts flowing through the discharge tube 23. And t3 to t4 are timings at which the current level of the discharge tube current I1 is adjusted.

The time division signal output circuit 48 determines the duty ratio of the time division signal S2 in accordance with the luminance level designated by the luminance designation signal S1, and outputs the time division signal S2 having the determined duty ratio.

As shown in FIG. 2A, the time division signal S2 rises to H level at the timing t0. In the period in which the time division signal S2 is H level 47, the diode 47 is turned on and the output terminal of the time division signal output circuit 48 and the negative input terminal (−) of the error amplifier 41 become electrically connected. Accordingly, the capacitor 42 is charged with the voltage of the time division signal S2. Due to this, the voltage signal E1 of the error amplifier 41 decreases, as shown in FIG. 2B. The decreased voltage signal E1 is applied to the control circuit 49 via the subtractor 46.

The control circuit 49 supplies the DC-AC conversion circuit 10 with a control signal for controlling the switching frequencies of the MOSFETs 11 and 12 to differ from the resonance frequency based on the decreased voltage signal of the integration circuit 40. At this time, the resonance circuit 20 is damped and the resonance effect is inhibited. Since the resonance effect is inhibited, the no voltage is induced in the secondary coil 21*b*. Accordingly, the discharge tube current I1 is shut off as shown in FIG. 2C.

Next, at the timing t1, the time division signal S2 changes from H level to L level as shown in FIG. 2A. In the period in which the time division signal S2 is L level, the diode 47 is turned off and the output terminal of the time division signal output circuit 48 and the negative input terminal (−) of the error amplifier 41 become electrically disconnected. Due to this, the time division signal S2 is not supplied and the capacitor 42 therefore starts discharging. At this time, the charge of the capacitor 42 is discharged by a discharge current represented by the following formula (1).

$$\text{Discharge current} = \text{reference voltage Vr}/(\text{resistance 33} + \text{resistance 43}) \quad (1)$$

Along with the discharging of the capacitor 42, the negative input terminal (−) of the error amplifier 41 starts decreasing, and the voltage signal E1 of the error amplifier 41 starts increasing at timings t1 to t3 as shown in FIG. 2B. The voltage signal E1 of the error amplifier 41 is supplied to the control circuit 49 via the subtractor 46.

The control circuit 49 supplies the DC-AC conversion circuit 10 with a control signal for controlling the switching frequencies of the MOSFETs 11 and 12 to approach the resonance frequency based on the increased voltage signal of the integration circuit 40. The resonance circuit 20 is excited and a resonance voltage is induced in the secondary coil 21*b* of the transformer.

Due to the resonance voltage, a current I1 flows through the discharge tube 23 at the timing t3 as shown in FIG. 2C and the discharge tube 23 is lit again.

The positive voltage of the discharge tube current I1 is input to the error amplifier 41 via the discharge tube current detection circuit 30. At the timings t3 to t4, the control circuit 49 controls the switching frequencies of the MOSFETs 11 and 12 in a manner to increase the current flowing through the discharge tube 23.

Then, at the timings t4 to t5, the control circuit 49 performs feedback control in a manner that the detected voltage of the discharge tube current detection circuit 30 and the reference voltage Vr will be equal to each other in potential difference.

By this operation, the discharge tube operation device according to the present embodiment adjusts the lit period and unlit period of the discharge tube 23 in accordance with repetition of H level and L level of the time division signal S2. That is, the time division signal S2 is a signal that repeatedly instructs the lit period and unlit period of the discharge tube 23 in order to time-division-drive the discharge tube 23, and is a signal that transmits energy capable of lighting the discharge tube 23 from the DC-AC conversion circuit 10 to the resonance circuit 20 in a period in which it instructs lighting, whereas transmitting energy incapable of lighting the discharge tube 23 from the DC-AC conversion circuit 10 to the resonance circuit 20 in a period in which it instructs non-lighting.

When the time division signal S2 falls from H to L level, the waveform of the voltage signal E1 of the error amplifier 41 has, as shown in FIG. 2B, a transitional inclination determined by a time constant τ of the integration circuit 40 which is defined by the resistances of the resistors 33 and 43 and the capacitance of the capacitor 42.

That is, the time at which the voltage signal E1 of the error amplifier 41 starts increasing is affected by the speed at which the terminal voltage of the capacitor 42, which is the feedback capacitor of the error amplifier 41, approaches the reference voltage level.

As described above, the discharge tube operation device according to the present embodiment has the following advantages.

(1) The point of start of the inclination of the voltage signal E1 of the error amplifier 41 is the timing t1 at which the time division signal S2 becomes L level, as shown in FIG. 2B. Since the voltage signal E1 starts changing immediately after the time division signal S2 changes, the control circuit 49 can perform its control operation without causing a delay. Accordingly, the control circuit 49 can quickly follow the change of the time division signal S2, and therefore the accuracy of the frequency varying control operation of the control circuit 49 is improved and no overrun is caused in the feedback control system. This contributes to suppression of occurrence of a surge.

(2) Further, since the time from t1 to t3 which is taken for the discharge tube current I1 to start flowing through the discharge tube 23 after the time division signal S2 changes from H to L level is short as shown in FIG. 2C, a gap between the period in which the time division signal S2 remains L level and the period in which the discharge tube current I1 is flowing is reduced. Accordingly, the discharge tube lit period t3 to t5 is increased, and the light emitting luminance of the discharge tube 23 reaches the luminance level designated by the luminance designation signal S1 because of the sufficient lit period available. As a result, the discharge tube 23 can achieve a desired illuminance.

Second Embodiment

Figure 3:
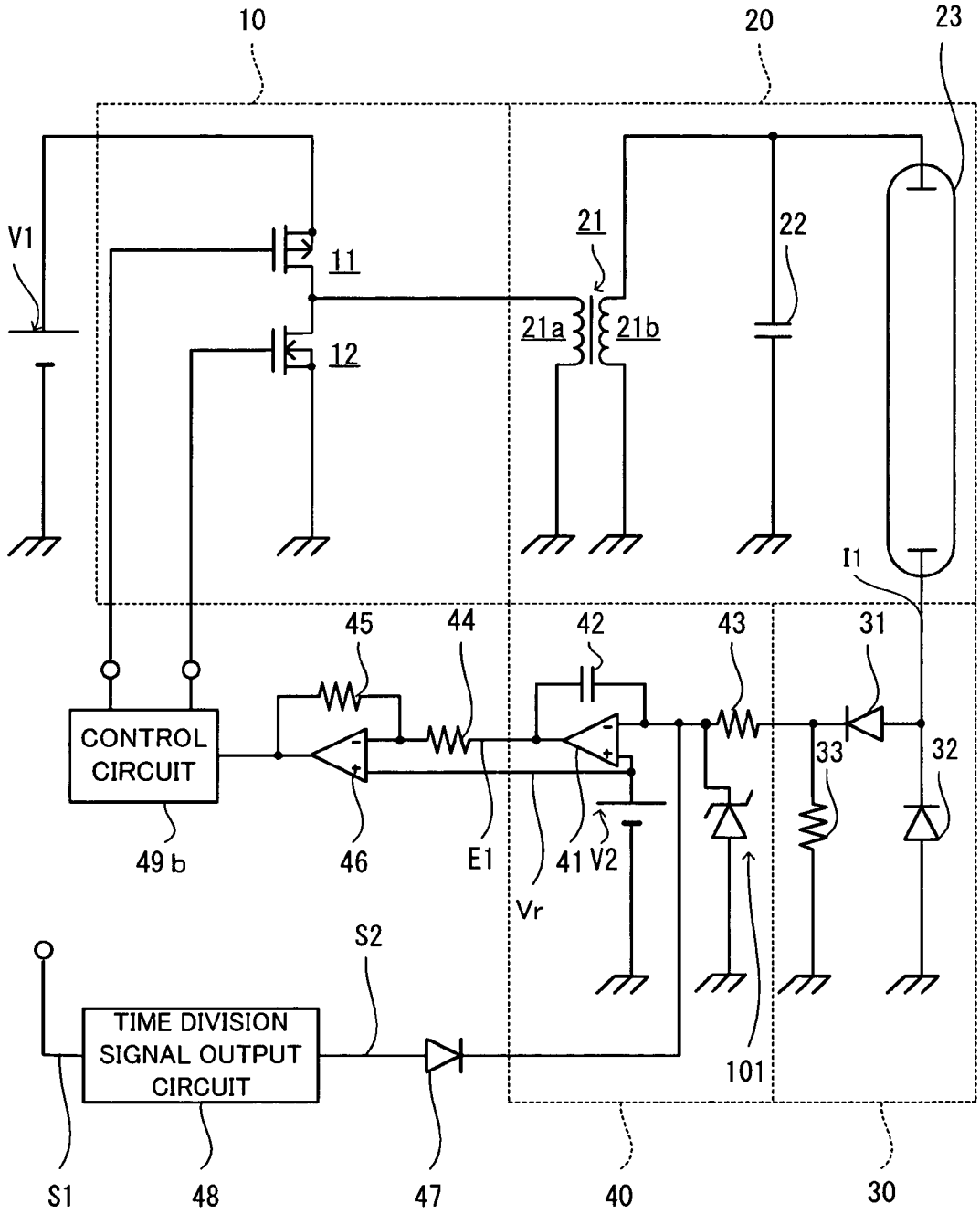
FIG. 3 is a circuit diagram showing the configuration of a discharge tube operation device according to a second embodiment of the present invention.
Figure 4:
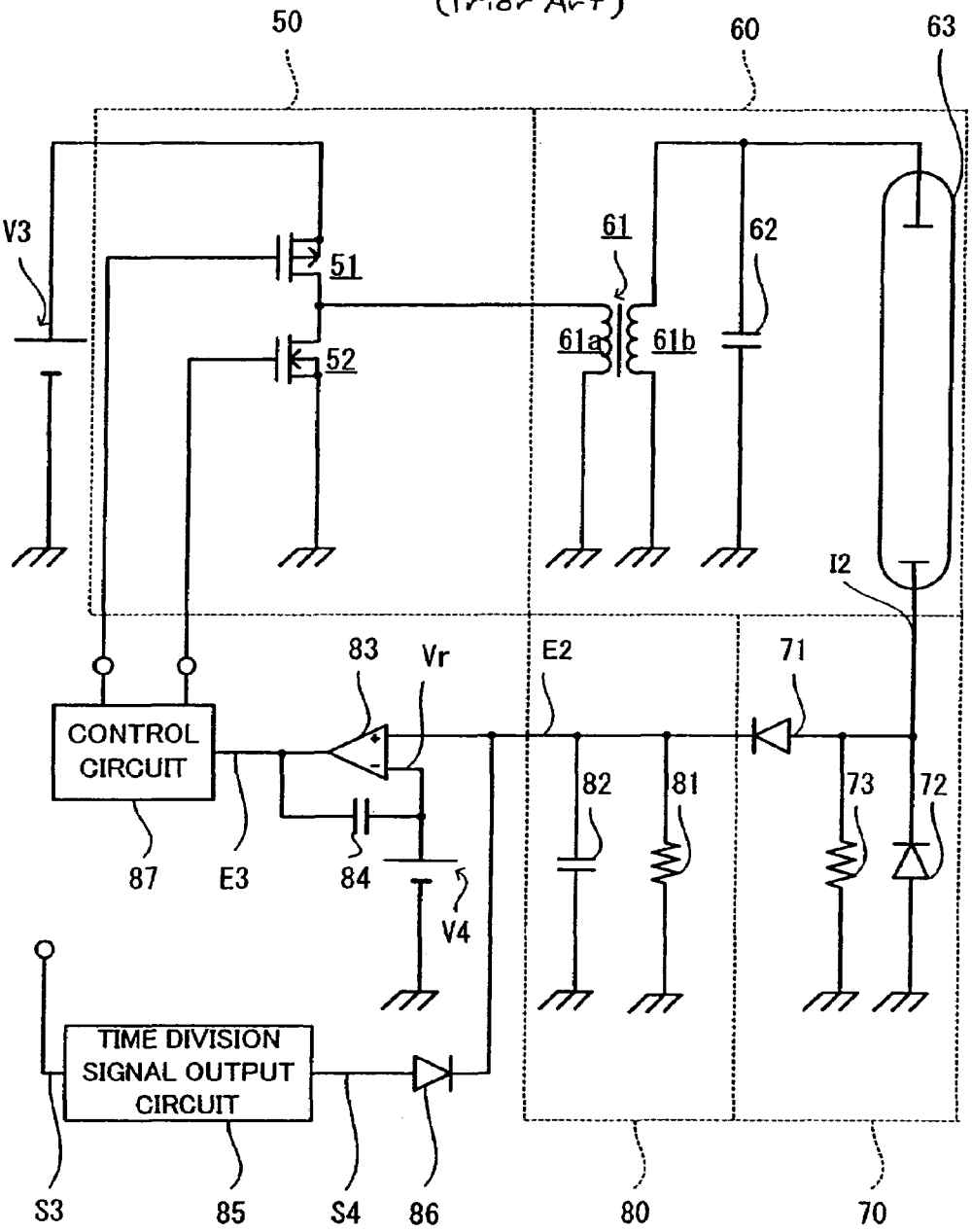
FIG. 4 (Prior Art)
FIG. 4 is a circuit diagram showing the configuration of a conventional discharge tube operation device.
Figures 5A, 5B, 5C, 5D:
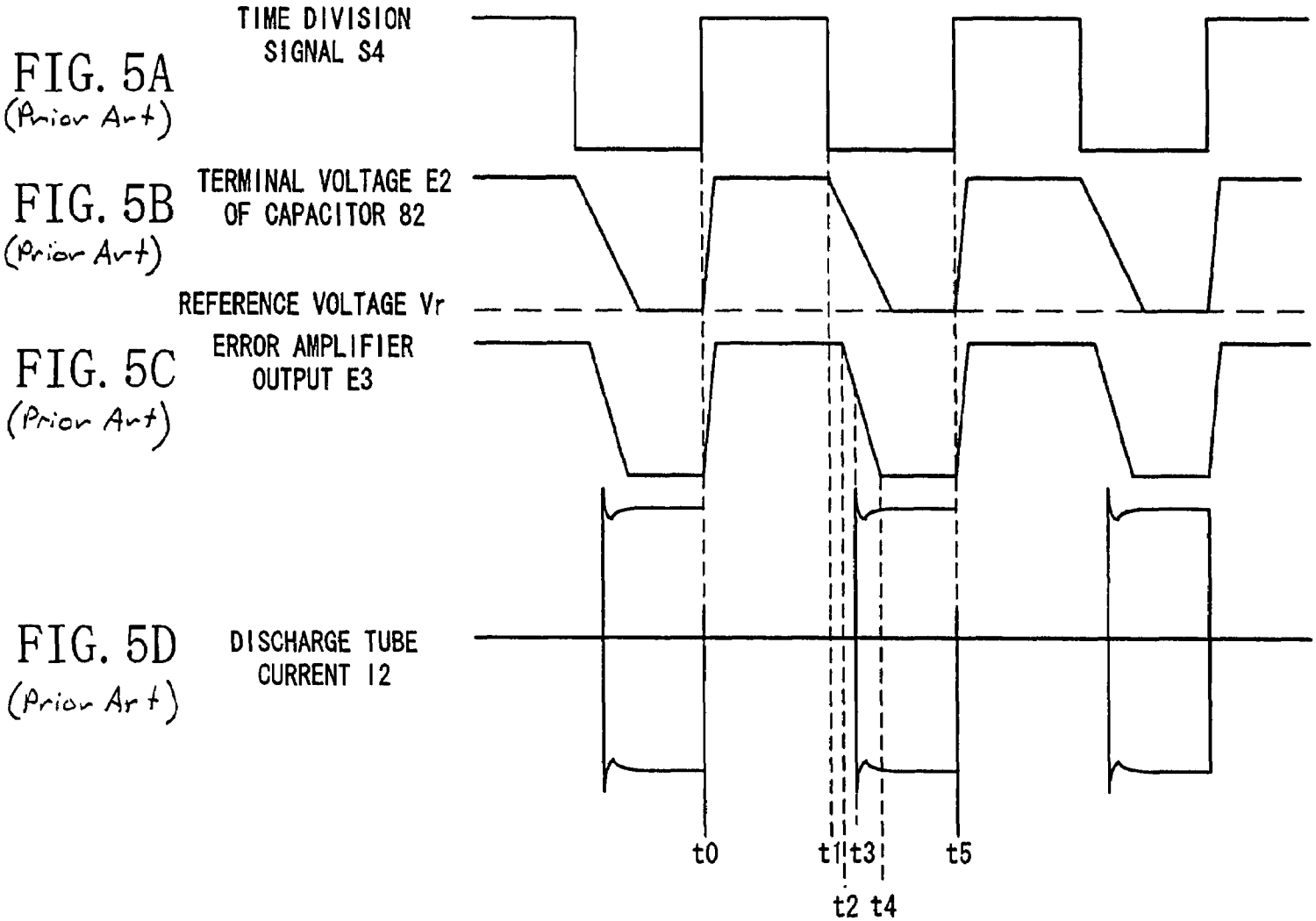
FIG. 5A (Prior Art)
FIG. 5B (Prior Art)
FIG. 5C (Prior Art)
FIG. 5D (Prior Art)
FIG. 5 are diagrams of output waveforms in a case where a time constant is small in the conventional discharge tube operation device.
Figures 6A, 6B, 6C, 6D:
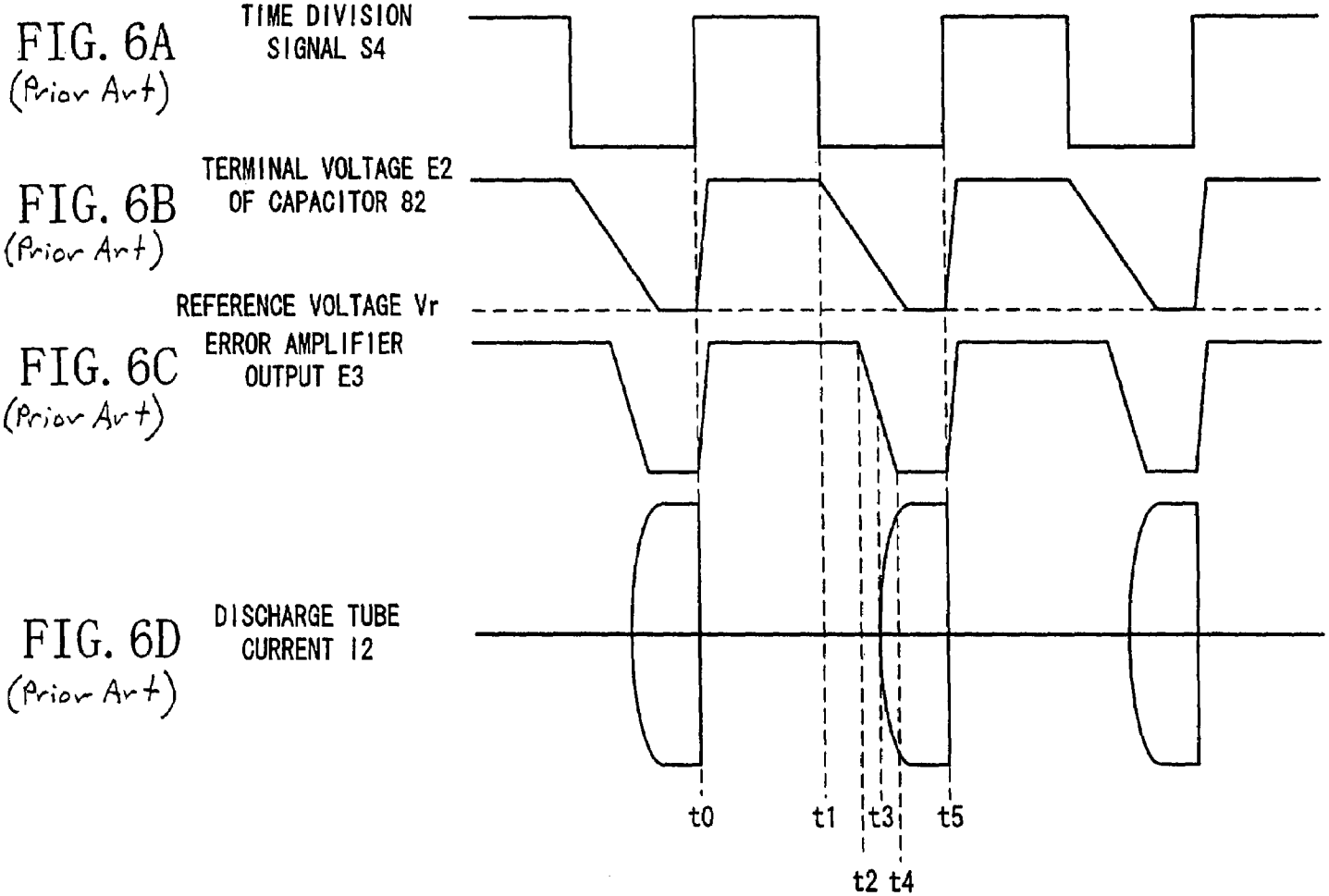
FIG. 6A (Prior Art)
FIG. 6B (Prior Art)
FIG. 6C (Prior Art)
FIG. 6D (Prior Art)
FIG. 6 are diagrams of output waveforms in a case where a time constant is large in the conventional discharge tube operation device.

FIG. 3 is a block diagram of a discharge tube operation device according to the second embodiment of the present invention.

The control circuit 49 of a frequency varying type is used in the first embodiment, but a control circuit 49*b* of a PWM (Pulse Width Modulation) control type may be used.

Since the discharge tube operation device has a similar configuration to the first embodiment, the same elements as in FIG. 1 will be given the same reference numerals, and only the matters that are different from the first embodiment will be explained and explanation for the others will be omitted.

With such a configuration, the control circuit 49*b* outputs a duty ratio control signal for controlling the duty ratio of the output from the MOSFETs 11 and 12. Since the voltage to be applied to the resonance circuit 20 is controlled by the duty ratio control signal, the current I1 that will flow through the discharge tube 23 is controlled. The time division signal output circuit 48 generates a time division signal S2 having a signal level that will give a duty ratio at which energy sufficient for lighting will be transmitted in a period in which lighting of the discharge tube 23 is instructed, and that will give a duty ratio at which such energy as not to allow lighting will be transmitted in a period in which non-lighting of the discharge tube 23 is instructed.

By the control circuit 49*b* performing such an operation, the discharge tube operation device according to the present embodiment can achieve similar effects to those of the first embodiment. Accordingly, the discharge tube operation device can obtain a desired illuminance and can perform a soft-start operation that would suppress occurrence of a surge in the discharge tube 23.

Further, it is also reasonable to consider that the control circuit 49*b* generates a control signal for changing the width of the pulse which the DC-AC conversion circuit 10 generates by its switching a direct-current voltage. The resonance circuit 20 induces a voltage based on the width of the pulse output from the DC-AC conversion circuit 10, and flows a current through the discharge tube 23 based on this voltage to light the discharge tube 23. The discharge tube current detection circuit 30 detects the current level of the current flowing through the discharge tube 23, and outputs an electric signal corresponding to this current level. In this case, the time division signal output circuit 48 may be so configured as to supply the integration circuit 40 with an electric signal on which embedded is a time division signal S2 whose electric signal level changes in the periodic unlit period in which the discharge tube 23 is unlit, thereby to change the output signal of the integration circuit 40 in order to change the width of the pulse in the unlit period and make the discharge tube 23 unlit whereby adjusting the illuminance.

The present invention is not limited to the above-described embodiments, but may be modified and applied in various manners.

For example, bipolar transistors may be used instead of the MOSFETs 11 and 12.

The manner of connecting the MOSFETs 11 and 12 may be full bridge connection instead of complementary connection.

The control circuit 49 performs the operation of controlling the resonance voltage level of the resonance circuit 20 when the input signal becomes L level, but may control the resonance voltage level of the resonance circuit 20 when the input signal is H level. In this case, the subtractor 46 may not be installed.

The discharge tube current detection circuit 30 detects the positive voltage from the voltage of the discharge tube current I1, but may detect the negative voltage provided that the orientation of the diodes 31 and 32 in the discharge tube current detection circuit 30 is reversed.

By such an operation as above being performed, the subtractor 46 used as an inverting amplifier circuit may not be installed.

Instead of the diode 47, a switching element such as a MOSFET or the like that is switched on in a period in which the time division signal S2 is H level and is switched off in a period in which the time division signal S2 is L level may be used with no problem.

The present invention is based on Japanese Patent Application No. 2003-21106 filed on Jan. 29, 2003 and includes the specification, claims, drawings and abstract thereof. The disclosure of the above Japanese Patent Application is incorporated herein by reference in its entirety.

INDUSTRIAL APPLICABILITY

The present invention can be used in industrial fields where a discharge tube operation device for adjusting the illuminance of a discharge tube by adjusting the current flowing through the discharge tube is used.

The invention claimed is:

1. A discharge tube operation device comprising:

a DC-AC conversion circuit which generates an alternating-current voltage by switching a direct-current voltage in accordance with a control signal;

a resonance circuit which is supplied with the alternating-current voltage from said DC-AC conversion circuit and resonates with the alternating-current voltage thereby to flow a current through a discharge tube, which is an object of lighting, and light said discharge tube;

a discharge tube current detection circuit which detects a current level of the current flowing through said discharge tube and outputs an electric signal level corresponding to the detected current level;

an integration circuit which includes difference circuit for obtaining a difference between a reference level and the electric signal, a capacitor connected between an input terminal and output terminal of said difference circuit, and an element for setting a charging/discharging speed of said capacitor, and integrates the electric-signal;

a control circuit which controls switching of said DC-AC conversion circuit in accordance with a signal level of an output signal of said integration circuit, thereby to output a control signal for controlling energy to be transmitted from said DC-AC conversion circuit to said resonance circuit; and a time division signal output circuit which generates a time division signal, which is a signal for repeatedly instructing a lit period and an unlit period of said discharge tube for time-division-driving said discharge tube and has a signal level that transmits energy capable of lighting said discharge tube from said DC-AC conversion circuit to said resonance circuit in a period in which lighting is instructed and that transmits energy incapable of lighting said discharge tube from said DC-AC conversion circuit to said resonance circuit (20) in a period in which non-lighting is instructed, and adds the time division signal to the signal level of the detection signal.

2. The discharge tube operation device according to claim 1, wherein:

said DC-AC conversion circuit switches a direct-current voltage at a frequency which is in accordance with the control signal;

said resonance circuit has a unique resonance frequency, and resonates when a frequency of the alternating-current voltage supplied from said DC-AC conversion circuit coincides with the resonance frequency thereby to flow a current through said discharge tube, which is the object of lighting, and light said discharge tube;

said control circuit controls a switching frequency of said DC-AC conversion circuit in accordance with the signal level of the output signal of said integration circuit; and said time division signal output circuit generates a time division signal, which is a signal for repeatedly instructing a lit period and an unlit period of said discharge tube for time-division-driving said discharge tube and has a signal level that makes the frequency of the alternating-current voltage coincide with the resonance frequency in a period in which lighting is instructed and that makes the frequency of the alternating-current voltage differ from the resonance frequency in a period in which non-lighting is instructed, and adds the time division signal to the signal level of the detection signal.

3. The discharge tube operation device according to claim 1, wherein:

said DC-AC conversion circuit switches a direct-current voltage at a duty ratio which is in accordance with the control signal;

said resonance circuit has a unique resonance frequency, and resonates when a frequency of the alternating-current voltage supplied from said DC-AC conversion circuit coincides with the resonance frequency thereby to flow a current through said discharge tube, which is the object of lighting;

said control circuit controls the duty ratio of switching of said DC-AC conversion circuit in accordance with the signal level of the output signal of said integration circuit; and said time division signal output circuit generates a time division signal (S2), which is a signal for repeatedly instructing a lit period and an unlit period of said discharge tube for time-division-driving said discharge tube and has a signal level that gives a duty ratio at which energy sufficient for lighting is transmitted in a period in which lighting is instructed and that gives a duty ratio at which energy incapable of lighting is transmitted in a period in which non-lighting is instructed, and adds the time division signal to the signal level of the detection signal.

4. A discharge tube operation device comprising:

a DC-AC conversion circuit which generates an alternating-current voltage by switching a direct-current voltage in accordance with a control signal;

a resonance circuit which is supplied with the alternating-current voltage from said DC-AC conversion circuit and resonates with the alternating-current voltage thereby to flow a current through a discharge tube, which is an object of lighting, and light said discharge tube;

a discharge tube current detection circuit which detects a current level of the current flowing through said discharge tube and outputs a detection signal having a signal level corresponding to the detected current level;

an integration circuit which includes a feedback capacitor and integrates the signal level of the detection signal;

a control circuit which controls switching of said DC-AC conversion circuit in accordance with a signal level of an output signal of said integration circuit, thereby to output a control signal for controlling energy to be transmitted from said DC-AC conversion circuit to said resonance circuit; and a time division signal output circuit which generates a time division signal, which is a signal for repeatedly instructing a lit period and an unlit period of said discharge tube for time-division-driving said discharge tube and has a signal level that transmits energy capable of lighting said discharge tube from said DC-AC conversion circuit to said resonance circuit in a period in which lighting is instructed and that transmits energy incapable of lighting said discharge tube from said DC-AC conversion circuit to said resonance circuit in a period in which non-lighting is instructed, and adds the time division signal to the signal level of the detection signal, wherein:

said feedback capacitor is a capacitor;

said integration circuit has an integration circuit resistive element;

said discharge tube current detection circuit has a discharge tube current detection resistive element for detecting a voltage of the current flowing through said discharge tube; and a time constant of said integration circuit is determined by capacitance of said capacitor and resistances of said integration circuit resistive element and said discharge tube current detection element.

5. The discharge tube operation device according to claim 1, wherein said resonance circuit has a transformer which includes a primary coil (21*a*) that is connected to said DC-AC conversion circuit and a secondary coil that is coupled to said primary coil and supplies a voltage to said discharge tube.

6. A discharge tube operation device comprising:

a DC-AC conversion circuit which generates an alternating-current voltage by switching a direct-current voltage at a frequency which is in accordance with a control signal;

a resonance circuit which has a unique resonance frequency, is supplied with an alternating-current voltage from said DC-AC conversion circuit, and resonates when a frequency of the alternating-current voltage coincides with the resonance frequency thereby to flow a current through a discharge tube, which is an object of lighting, and light said discharge tube;

a discharge tube current detection circuit which detects a current level of the current flowing through said discharge tube, and outputs an electric signal corresponding to the detected current level;

an integration circuit which has a difference circuit for obtaining a difference between a reference level and the electric signal, a capacitor connected between an input terminal and output terminal of said difference circuit, and an element for setting a charging/discharging speed of said capacitor, and integrates the electric signal;

a control circuit which outputs a control signal for controlling a switching frequency of said DC-AC conversion circuit in accordance with a signal level of an output signal of said integration circuit; and a time division signal output circuit which generates a time division signal, which is a signal for repeatedly instructing a lit period and an unlit period of said discharge tube for time-division-driving said discharge tube and has a signal level that makes the frequency of the alternating-current voltage coincide with the resonance frequency in a period in which lighting is instructed and that makes the frequency of the alternating-current voltage differ from the resonance frequency in a period in which non-lighting is instructed, and adds the time division signal to the signal level of the detection signal.

7. A discharge tube operation device comprising;

a DC-AC conversion circuit which generates a pulse by switching a direct-current voltage in accordance with a control signal;

a resonance circuit which is connected to said DC-AC conversion circuit, generates a voltage based on a width of the pulse, and flows a current through said discharge tube based on the voltage thereby to light said discharge tube;

a discharge tube current detection circuit which is connected to said resonance circuit, detects a current level of the current flowing through said discharge tube, and outputs an electric signal corresponding to the current level;

an integration circuit which includes a difference circuit for obtaining a difference between a reference level and the electric signal, a capacitor connected between an input terminal and output terminal of said difference circuit, and an element for setting a charging/discharging speed of said capacitor, and integrates the electric signal;

a control circuit which generates a control signal for changing the width of the pulse based on an output signal of said integration circuit; and a time division signal output circuit which supplies a time division signal whose electric signal level changes in a periodic unlit period in which said discharge tube is unlit, to said integration circuit while embedding the time division signal on the electric signal, thereby to change the output signal of the integration circuit in the unlit period to change the width of the pulse, make said discharge tube unlit and adjust illuminance of said discharge tube.

8. A discharge tube operation device comprising:

a DC-AC conversion circuit which generates an alternating-current voltage by switching a direct-current voltage in accordance with a control signal;

a resonance circuit which is supplied with the alternating-current voltage from said DC-AC conversion circuit and resonates with the alternating-current voltage thereby to flow a current through a discharge tube, which is an object of lighting, and light said discharge tube;

a discharge tube current detection circuit which detects a current level of the current flowing through said discharge tube and outputs an electric signal level corresponding to the detected current level;

an integration circuit which includes an input terminal that inputs said electric signal level, a capacitor that integrates a signal level of said input terminal, and a clamp circuit that prevents a signal level of said capacitor from exceeding a predetermined value, said integration circuit outputting from an output terminal the integrated signal level of said electric signal level as an output signal;

a control circuit which controls switching of said DC-AC conversion circuit in accordance with a signal level of an output signal of said integration circuit, thereby to output a control signal for controlling energy to be transmitted from said DC-AC conversion circuit to said resonance circuit; and a time division signal output circuit which generates a time division signal, which is a signal for repeatedly instructing a lit period and an unlit period of said discharge tube for time-division-driving said discharge tube and has a signal level that transmits energy capable of lighting said discharge tube from said DC-AC conversion circuit to said resonance circuit in a period in which lighting is instructed and that transmits energy incapable of lighting said discharge tube from said DC-AC conversion circuit to said resonance circuit in a period in which non-lighting is instructed, and adds the time division signal to the signal level of the detection signal.

9. The discharge tube operation device according to claim 8, wherein:

said DC-AC conversion circuit switches a direct-current voltage at a frequency which is in accordance with the control signal;

said resonance circuit has a unique resonance frequency, and resonates when a frequency of the alternating-current voltage supplied from said DC-AC conversion circuit coincides with the resonance frequency thereby to flow a current through said discharge tube, which is the object of lighting, and light said discharge tube;

said control circuit controls a switching frequency of said DC-AC conversion circuit in accordance with the signal level of the output signal of said integration circuit; and said time division signal output circuit generates a time division signal, which is a signal for repeatedly instructing a lit period and an unlit period of said discharge tube for time-division-driving said discharge tube and has a signal level that makes the frequency of the alternating-current voltage coincide with the resonance frequency in a period in which lighting is instructed and that makes the frequency of the alternating-current voltage differ from the resonance frequency in a period in which non-lighting is instructed, and adds the time division signal to the signal level of the detection signal.

10. The discharge tube operation device according to claim 8, wherein:

said DC-AC conversion circuit switches a direct-current voltage at a duty ratio which is in accordance with the control signal;

said resonance circuit has a unique resonance frequency, and resonates when a frequency of the alternating-current voltage supplied from said DC-AC conversion circuit coincides with the resonance frequency thereby to flow a current through said discharge tube, which is the object of lighting;

said control circuit controls the duty ratio of switching of said DC-AC conversion circuit in accordance with the signal level of the output signal of said integration circuit; and said time division signal output circuit generates a time division signal, which is a signal for repeatedly instructing a lit period and an unlit period of said discharge tube for time-division-driving said discharge tube and has a signal level that gives a duty ratio at which energy sufficient for lighting is transmitted in a period in which lighting is instructed and that gives a duty ratio at which energy incapable of lighting is transmitted in a period in which non-lighting is instructed, and adds the time division signal to the signal level of the detection signal.

* * * * *